United States Patent [19]

Pousette

[11] Patent Number: 4,784,196

[45] Date of Patent: Nov. 15, 1988

[54] METHOD AND APPARATUS FOR DEBARKING LOGS

[75] Inventor: Ronald D. Pousette, Vancouver, Canada

[73] Assignee: Brunette Machine Works, Ltd., Vancouver, Canada

[21] Appl. No.: 50,020

[22] Filed: May 15, 1987

[51] Int. Cl.[4] ..... B27L 7/00

[52] U.S. Cl. ..... 144/341; 144/208 E

[58] Field of Search ..... 144/208 E, 341

[56] References Cited

U.S. PATENT DOCUMENTS

| | | | |
|---|---|---|---|
| 1,887,908 | 11/1932 | Tidblad | 144/208 E |
| 2,109,414 | 2/1938 | Deiters et al. | 144/208 E |
| 3,221,785 | 12/1965 | Valo | 144/208 E |
| 3,361,168 | 1/1968 | Brown | 144/208 E |

FOREIGN PATENT DOCUMENTS

| | | | |
|---|---|---|---|
| 28928 | 3/1957 | Finland | 144/208 E |
| 91571 | 4/1958 | Norway | 144/208 E |
| 116522 | 6/1946 | Sweden | 144/208 E |

*Primary Examiner*—W. Donald Bray

*Attorney, Agent, or Firm*—Kolisch, Hartwell & Dickinson

[57] ABSTRACT

A method and apparatus for debarking logs of the type having long-fibre bark. In a first debarking operation, rotary cutterheads remove a portion of the mark so as to leave a bark/no-bark, barber-pole pattern on a log's surface. In a second, downstream debarking operation, scrapers on a rotating ring remove the remaining bark.

4 Claims, 1 Drawing Sheet

METHOD AND APPARATUS FOR DEBARKING LOGS

BACKGROUND OF THE INVENTION

This invention pertains to a method and apparatus for debarking logs, and more particularly, to such a method and apparatus which are specially designed to handle logs having long-fibre bark.

For years, logs which have long-fibre bark have created serious problems for rotary ring-type debarkers. Bark leaving such a log tends to come off in long ropes which tend to ball up and create a tangled jam in and around the ring or rotor.

Others in the past have attempted to address this problem, but not with the high degree of success which the industry would like. For example, Palmquist, in U.S. Pat. No. 3,991,800, discloses a log-debarking machine which is intended to avoid the long-fibre bark problem. Featured in this machine are two hollow, rotor-type processing units, with the upstream unit having tools designed to produce a helical cut in bark, and with the downstream unit including revolving tools that further loosen and remove the bark from a log's surface. The upstream unit does not remove any bark. With all bark removal occurring solely in the downstream unit, there is still a clear opportunity for removed bark to create a jam.

Continuing to recognize the need for significant improvement in dealing with this problem, the industry later developed the rotary cutterhead-type debarker. In this kind of machine, plural (typically three) rotary cutterheads, which look somewhat like helical gears, are carried on arms, and rotate at high speed to cut and scrub against the outside surface of a log. Illustrative of such a debarker is the Ishida Brunette IBD-N360.500 debarker. While this kind of a machine has proven to be extremely effective in removing long-fibre bark with avoidance of the tangle/jam situation, it offers relatively low throughput speed.

With this background in mind, a general object of the present invention is to address the long-standing challenge of removing long-fibre bark from a log successfully, at the highest-possible throughput speed.

According to a preferred embodiment of the invention, the same proposes a unique linkage between a cutterhead-type debarker and a scraper-type debarker. Proposed, therefore, according to the invention, is an upstream debarking station in which rotary cutterheads are employed partially to remove bark, in such a manner that an emerging log has a bark/no-bark, "barber-pole" pattern on its surface. Travel through this first debarking station, where only partial debarking takes place, is characterized by relatively high throughput speed. Cooperating with this first, upstream debarking station is a second, downstream station in which remaining bark is removed by scraper arms carried on a rotary ring.

The method of the invention can be described as performing a first, partial debarking operation to produce a bark/no-bark, barber-pole pattern on a log, which pattern is characterized by alternating zones of bark and no-bark, and thereafter performing a second debarking operation to remove the remaining bark.

Experience has shown that by using cutterheads to create partial bark removal as described, remaining bark can easily be handled by well-known scraper arms. No balling-up or tangling occurs. And, with the cutterheads not being relied upon to do all of the debarking, it is possible to achieve successful debarking with satisfactorily high throughput rates.

Still another important feature of the system proposed by the present invention is that it is readily "convertible" to handle high-speed debarking of non-long-fibre-bark logs in areas where both kinds of logs are available for processing. The conversion alluded to is accomplished simply by shifting the cutterheads in the upstream debarking station away from the path of a log so that the log only engages the blades in the scraper-type debarker.

These and other objects and advantages which are attained by the invention will become more fully apparent as the description which now follows is read in conjunction with the accompanying drawings.

p DESCRIPTION OF THE DRAWINGS

DETAILED DESCRIPTION OF THE INVENTION

Figure 1:
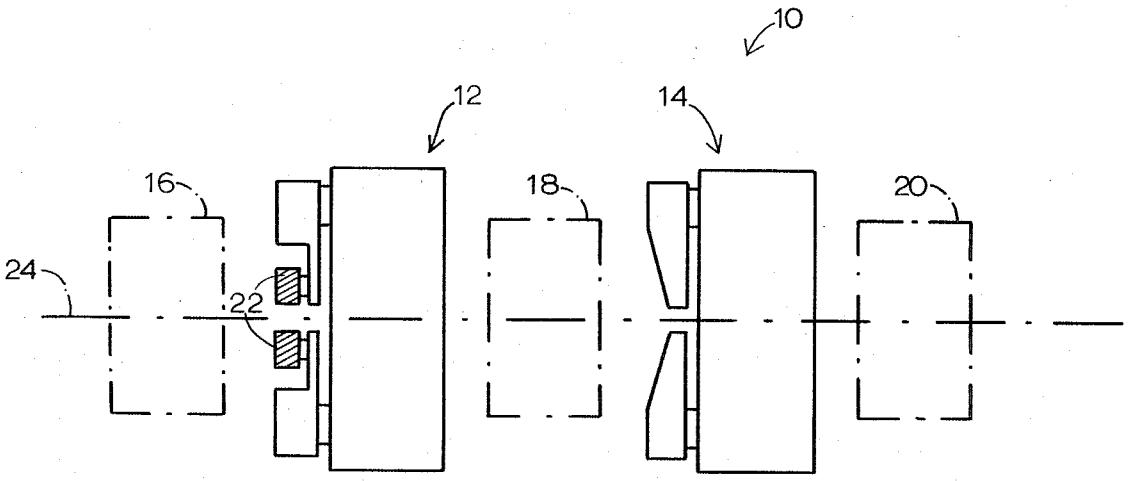
FIG. 1 is a simplified, schematic, plan view illustrating an organization (system) of debarking apparatus constructed in accordance with the present invention.

Turning now to the drawings, and referring first of all to FIG. 1, here there is shown at 10 a simplified plan view of a debarking system which has been constructed, and which performs, in accordance with the essence of the present invention. System 10 includes a first, upstream debarking station 12, and a second, downstream debarking station 14. At 16, 18, 20 are three, conventional power-driven feed-roll machines, with machine 16 being upstream from station 12, machine 18 being intermediate the two debarking stations, and machine 20 being downstream from station 14.

Each of the main units of the system so far described is entirely conventional in construction, and accordingly, is illustrated only in simple schematic form herein. The organization of these units, however, and particularly the organization of the two debarking stations, is entirely unique.

Debarking station 12 is formed by a rotary cutterhead debarker, or first rotary means which, on a revolving hollow ring, includes a plurality (typically three) of power-driven rotary cutterheads, or cutterhead means, such as the two shown at 22. These three cutterheads are also referred to herein as a first set of rotary tools. A commercially available debarker of this type has already been identified above, and the same is known to perform admirably in the setting of this invention.

While specific dimensional and operational features may vary from system to system, cutterheads 22 typically have an axial length, measured in the same direction as the axis 24 of system 10, of about 5-inches, and a diameter of about 8 to 10-inches. They rotate under power at about 1,000-rpm, and revolve on their carrying ring at a rate of about 80- to 100-rpm. The diagonal lines used in FIG. 1 with respect to these cutterheads symbolize their helical gear-like peripheries which perform a cutting/scrubbing operation.

Debarking station 14 preferably takes the form of a conventional, high-speed, six-scraper-arm, rotary, ring-type debarker, or second rotary means such as the one made and sold by Brunette Machine Works Limited of New Westminster, British Columbia, Canada, identified as a Brunette high speed mechanical ring debarker. The scraper tips, or scraper means, on these arms have axial lengths, that is, lengths measured parallel to axis 24, of about 3-inches, with the rotary ring in the debarker turning at a speed of around 150-to around 300-rpm. The scraper arms are also referred to herein as a second set of rotary tools.

Figure 2:
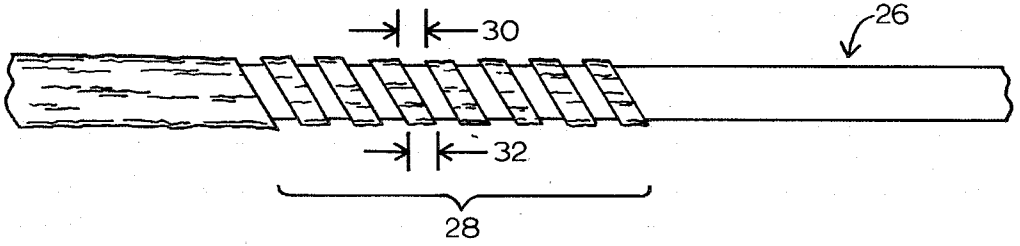
FIG. 2 is a fragmentary, simplified view of a log passing through the system of FIG. 1, with there being a vertical-axis relationship between FIGS. 1 and 2 to help illustrate, generally, the surface condition of a log at different locations in the system.

Considering now FIG. 2 along with FIG. 1, there is shown at 26 in FIG. 2 a fragmentary portion of a log which, for the purpose of the description that now follows, is assumed to be working its way along axis 24, in the direction of arrow 27, through system 10. As was mentioned earlier, there is a vertical-axis relationship between FIGS. 1 and 2. So, if one now imagines log 26 being displaced vertically in FIG. 2, into a central position along axis 24, the surface condition of the log, as depicted in FIG. 2, is seen to relate to the debarking operations performed in stations 12, 14. More specifically, until a particular upstream stretch of the log reaches cutterheads 22, it is substantially completely covered with bark. As it moves past these cutterheads, and considering a log-feed speed of about 150-feet per-minute, the cutterheads partially remove bark to create the barber-pole-like, bark/no-bark pattern which appears generally in bracketed region 28 in FIG. 2. With the operational speeds and dimensions given above, this barber-pole pattern is characterized by zones, such as zone 30, having no bark and having a width (measured axially) of about 5-inches, alternating with zones, such as zone 32, which still have bark, and which may be, for example, from about 5- to 15- or 20-inches in width.

As the surface of the log engages the scraper tips in station 14, these tips remove all remaining bark, and the log emerges debarked from the system.

In a region where logs that arrive for debarking include both long-fibre bark and non-long-fibre bark, debarking of the latter is easily handled by shifting the cutterheads, such as cutterheads 22, out of the path of log travel so that the log only becomes engaged by the scraper blades in debarking station 14.

The important features and advantages of the apparatus and method of the invention should now be very apparent. Long-fibre bark is handled in a two-stage debarking operation in which bark is first partially removed to create a barber-pole-like pattern of remaining bark, and thereafter treated by scraping to remove all of the remaining bark. Relatively high throughput is possible, and the problem of long ropes of bark fouling up the system simply does not exist.

Accordingly, while a preferred embodiment of, and method of practicing, the invention have been disclosed herein, it is appreciated that variations and modifications may be made without departing from the spirit of the invention.

It is claimed and desired to secure by letters patent:

1. Apparatus for debarking logs having long-fibre bark comprising a first debarking station including first rotary means having operatively associated revolving cutterhead means operable to remove a portion of a log's bark as the log moves through the station, so as to leave a bark/no-bark, barber-pole pattern on the log, and a second debarking station downstream from said first station, adapted to receive a log exiting the latter and including second rotary means having operatively associated scraper means operable to remove the remaining bark.

2. The apparatus of claim 1, wherein said cutterhead means includes at least one rotary cutterhead.

3. A method for debarking logs having long-fibre bark comprising the step of performing, utilizing a first set of rotary tools including revolving cutterheads, a first, partial debarking operation to produce a bark/no-bark pattern on a log characterized, progressing longitudinally along the log's thus-treated surface, in alternating bark/no-bark zones, and thereafter the step of performing, utilizing a second set of rotary tools including scrapers, a second debarking operation to remove the remaining bark.

4. A method for debarking logs having long-fibre bark comprising in a first, partial debarking operation, subjecting a log's surface to at least one rotary, revolving cutterhead to produce a bark/no-bark, barber-pole pattern on the log, and thereafter in a second debarking operation, subjecting the log's surface to at least one rotary scraper to remove the remaining bark.

* * * * *